US008951704B2

(12) United States Patent
Horiba et al.

(10) Patent No.: US 8,951,704 B2
(45) **Date of Patent: *Feb. 10, 2015**

(54) TONER, LIQUID DEVELOPER, DRY DEVELOPER, DEVELOPER CARTRIDGE, PROCESS CARTRIDGE, IMAGE FORMING APPARATUS, AND IMAGE FORMING METHOD

(71) Applicant: Fuji Xerox Co., Ltd., Tokyo (JP)

(72) Inventors: Koji Horiba, Kanagawa (JP); Yoshihiro Inaba, Kanagawa (JP); Daisuke Yoshino, Kanagawa (JP); Takako Kobayashi, Kanagawa (JP); Akira Imai, Kanagawa (JP); Masahiro Oki, Kanagawa (JP); Hiroyuki Moriya, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/962,473

(22) Filed: Aug. 8, 2013

(65) Prior Publication Data

US 2014/0272693 A1 Sep. 18, 2014

(30) Foreign Application Priority Data

Mar. 15, 2013 (JP) ..... 2013-053611

(51) Int. Cl.

| | |
|---|---|
| ***G03G 9/00*** | (2006.01) |
| ***G03G 15/00*** | (2006.01) |
| ***G03G 9/087*** | (2006.01) |
| *G03G 15/08* | (2006.01) |
| *G03G 15/10* | (2006.01) |

(52) U.S. Cl.

CPC ..... *G03G 9/08755* (2013.01); *G03G 15/08* (2013.01); *G03G 15/10* (2013.01)

USPC ..... 430/105; 430/108.5; 430/109.1; 430/109.4; 430/117.1; 399/237; 399/252

(58) Field of Classification Search

USPC ..... 430/105, 109.1, 109.4, 117.1; 399/134, 399/252, 237

See application file for complete search history.

(56) References Cited

U.S. PATENT DOCUMENTS

| | | | | |
|---|---|---|---|---|
| 5,888,689 | A | 3/1999 | De Meutter et al. | |
| 8,658,338 | B2 * | 2/2014 | Horiba et al. | 430/105 |
| 2009/0068578 | A1 * | 3/2009 | Murakami et al. | 430/105 |
| 2013/0216943 | A1 * | 8/2013 | Horiba et al. | 430/105 |

FOREIGN PATENT DOCUMENTS

| | | |
|---|---|---|
| JP | A-56-11461 | 2/1981 |
| JP | A-62-39879 | 2/1987 |
| JP | A-10-78675 | 3/1998 |
| JP | A-2000-284527 | 10/2000 |
| JP | A-2003-29554 | 1/2003 |
| JP | A-2004-54256 | 2/2004 |
| JP | A-2006-337395 | 12/2006 |
| JP | A-2010-184470 | 8/2010 |

* cited by examiner

*Primary Examiner* — Thorl Chea
(74) *Attorney, Agent, or Firm* — Oliff PLC

(57) ABSTRACT

A toner includes a crystalline polyester resin having an unsaturated double bond, a thiol compound having a bi- or more-functional thiol group, and a photopolymerization initiator.

17 Claims, 1 Drawing Sheet

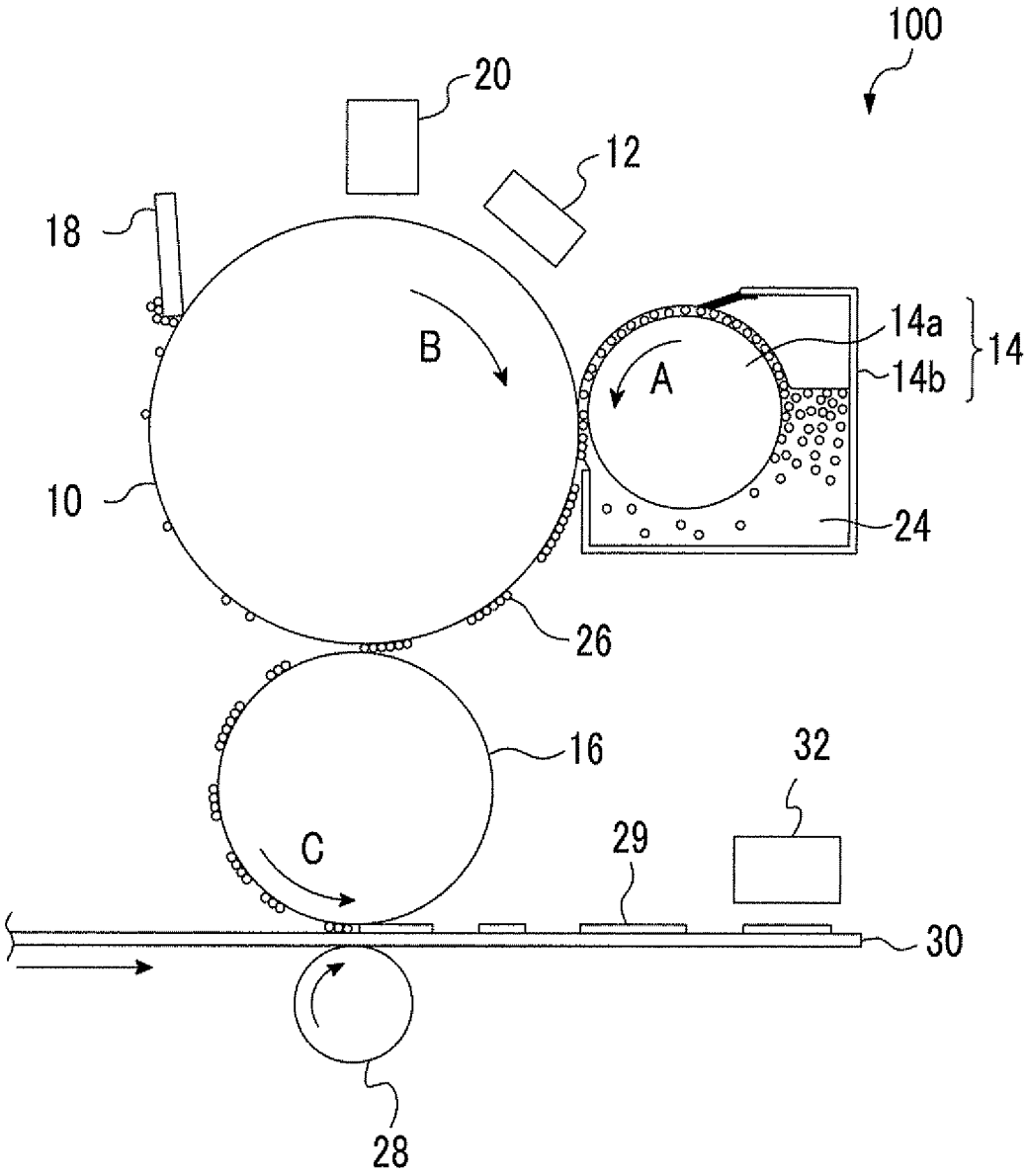
100
20
12
18
B
A
14a
14
14b
10
24
26
16
32
C
29
30
28

TONER, LIQUID DEVELOPER, DRY DEVELOPER, DEVELOPER CARTRIDGE, PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2013-053611 filed Mar. 15, 2013.

BACKGROUND

1. Technical Field

The present invention relates to a toner, a liquid developer, a dry developer, a developer cartridge, a process cartridge, an image forming apparatus, and an image forming method.

2. Related Art

A method such as electrophotography, in which image information is visualized through an electrostatic charge image, is currently being used in various fields. In electrophotography, an electrostatic latent image is formed on an image holding member through charging and exposure processes (latent image forming process); the electrostatic latent image is developed using an electrostatic charge image developer (hereinafter, sometimes, simply referred to as a "developer") containing a toner for developing an electrostatic charge image (hereinafter, sometimes, simply referred to as "toner") (developing process); and the developed image is visualized through transfer and fixing processes. As developers for dry development, there are two-component developers including toner and a carrier and single-component developer including a magnetic or nonmagnetic toner only.

A curable toner having, for example, UV curability for improving resistance and the like is known.

On the other hand, a liquid developer for wet development is obtained by dispersing toner particles in an insulating carrier solution, and, for example, a type in which toner particles containing a thermoplastic resin are dispersed in a volatile carrier solution and a type in which toner particles containing a thermoplastic resin are dispersed in a refractory carrier solution are known.

SUMMARY

According to an aspect of the invention, there is provided a toner including: a crystalline polyester resin having an unsaturated double bond; a thiol compound having a bi- or more-functional thiol group; and a photopolymerization initiator.

BRIEF DESCRIPTION OF THE DRAWING

Exemplary embodiments of the present invention will be described in detail based on the following FIGURE, wherein:

FIG. 1 is a diagram schematically illustrating a configuration example of an image forming apparatus according to an exemplary embodiment of the invention.

DETAILED DESCRIPTION

Hereinafter, an exemplary embodiment of the invention will be described. The exemplary embodiment is merely an example implementing the invention and does not limit the invention.

Toner

A toner according to an exemplary embodiment of the invention includes a crystalline polyester resin having an unsaturated double bond; a thiol compound having a bi- or more-functional thiol group; and a photopolymerization initiator. In the exemplary embodiment, it is considered that a low-temperature fixing property is superior by using the crystalline polyester resin having an unsaturated double bond, the thiol compound having a bi- or more-functional thiol group, and the photopolymerization initiator; and that an image is sufficiently cured even in the atmosphere and has superior scratch resistance by, after forming an image, curing the image through the photopolymerization of the unsaturated double bond of the crystalline polyester resin and the thiol group of the thiol compound with low oxygen inhibition. Using an ene-thiol reaction, an image has less curing shrinkage and is sufficiently cured in the atmosphere.

The crystalline polyester resin having an unsaturated double bond is not particularly limited, and examples thereof include a crystalline polyester resin obtained by polycondensating an unsaturated aliphatic dicarboxylic acid and an unsaturated aliphatic dial, a crystalline polyester resin obtained by polycondensating an unsaturated aliphatic dicarboxylic acid and an aliphatic diol, and a crystalline polyester resin obtained by polycondensating an aliphatic dicarboxylic acid and an unsaturated aliphatic dial. Among these, from the viewpoints of reactivity and the like, the crystalline polyester resin obtained by polycondensating an unsaturated aliphatic dicarboxylic acid and an unsaturated aliphatic diol is preferable. In the case of a polymer in which another component is copolymerized in a polyester main chain, when a content of another component is less than or equal to 50% by weight, this copolymer is also called a polyester resin.

Examples of the unsaturated aliphatic dicarboxylic acid include fumaric acid, maleic acid, citraconic acid, glutaconic acid, itaconic acid, and 3-hexenedioic acid; anhydrides thereof; and lower alkyl esters thereof. However, the unsaturated aliphatic dicarboxylic acid is not limited thereto. Among these, an unsaturated aliphatic dicarboxylic acid having from 4 to 8 carbon atoms is preferable.

Examples of the unsaturated aliphatic diol include 2-buten-1,4-diol. However the unsaturated aliphatic diol is not limited thereto. Among these, an unsaturated aliphatic dial having from 2 to 8 carbon atoms is preferable. In addition, the unsaturated aliphatic diol may be a mixture of geometric isomers.

Examples of the aliphatic dicarboxylic acid include oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, and 1,18-octadecanedicarboxylic acid; anhydrides thereof; and lower alkyl esters thereof. However, the aliphatic dicarboxylic acid is not limited thereto.

Examples of the aliphatic diol include ethylene glycol, 1,3-propanediol, 1,4-butanediol, 1,5-pentanedial, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol. However, the aliphatic dial is not limited thereto.

A weight average molecular weight of the crystalline polyester resin having an unsaturated double bond is preferably from 5,000 to 200,000. When the weight average molecular weight of the crystalline polyester resin having an unsaturated double bond is less than 5,000, scratch resistance may be poor due to insufficient curing. When the weight average molecular weight is greater than 200,000, insufficient fixing may occur.

The above-described weight average molecular weight (Mw) is measured by gel permeation chromatography (GPC). In the molecular weight measurement using GPC, LC-10AD (manufactured by Shimadzu Corporation) is used as a measurement instrument, a column (KF-805L, manufactured by Showa Denko K.K.) is used, and THF is used as a solvent. The above-described weight average molecular weight is calculated using a molecular weight calibration curve which is prepared from monodisperse polystyrene standard samples on the basis of the measurement results.

A method of preparing the crystalline polyester resin having an unsaturated double bond is not particularly limited. For example, the crystalline polyester resin may be prepared with a general polyester polymerization method of causing a dicarboxylic acid component and a diol component to react with each other.

In the exemplary embodiment, "crystallinity" of "crystalline resin" represents the property of a resin or a toner to have not a stepwise endothermic change but a clear endothermic peak in the differential scanning calorimetry (DSC) thereof. Specifically, in the differential scanning calorimetry (DSC) using a differential scanning calorimeter (product name: DSC-50; manufactured by Shimadzu Corporation) equipped with an automatic tangent line processing system, a resin or a toner is heated at a temperature rise rate of 10° C./min, is cooled with liquid nitrogen, and is heated again at a temperature rise rate of 10° C./min. At this time, when a temperature difference between an onset point and a peak top of an endothermic peak is within 10° C., it is considered that the resin or the toner has a "clear" endothermic peak. In a DSC curve, a point of a flat portion on a base line and a point of a flat portion of a fall portion from the base line are specified; and an intersection between tangent lines of the flat portions of both points is obtained by the automatic tangent line processing system as the "onset point".

A melting point of the crystalline polyester resin having an unsaturated double bond is preferably from 48° C. to 90° C. and more preferably from 50° C. to 80° C. When the melting point of the crystalline polyester resin having an unsaturated double bond is lower than 48°, scratch resistance may be low. When the melting point is higher than 90° C., a low-temperature fixing property may be low. The melting point of the crystalline polyester resin is obtained from the above-described "endothermic peak".

Among dicarboxylic acids to be used, an unsaturated aliphatic dicarboxylic acid may be used in combination with an aliphatic dicarboxylic acid or an aromatic dicarboxylic acid such as terephthalic acid or isophthalic acid. In this case, from the viewpoints of curability and the like, a content of the unsaturated aliphatic dicarboxylic acid is preferably greater than or equal to 80 mol %.

Among dials to be used, an unsaturated aliphatic diol may be used in combination with an aliphatic diol or an aromatic diol such as bisphenol A or an alcohol-modified product of bisphenol A. In this case, from the viewpoints of curability and the like, a content of the unsaturated aliphatic dial is preferably greater than or equal to 80 mol %.

A content of the crystalline polyester resin having an unsaturated double bond in the toner is not particularly limited, and, for example, is from 30% by weight to 80% by weight with respect to the total weight of the toner. When the content of the crystalline polyester resin having an unsaturated double bond in the toner is less than 30% by weight, insufficient curing may occur. When the content of the crystalline polyester resin having an unsaturated double bond in the toner is greater than 80% by weight, insufficient fixing may occur.

The thiol compound having a bi- or more-functional thiol group is not particularly limited and examples thereof include thiol compounds such as pentaerythritol tetrakis(3-mercaptobutylate), 1,3,5-tris(3-mercaptobutyloxyethyl) 1,3,5-triazine-2,4,6-(1H, 3H, 5H)-trione, 1,4-bis(3-mercaptobutyryloxy) butane, trimethylolpropanetris(3-mercaptobutyrate), and trimethylolethanetris(3-mercaptobutyrate) (all of which are manufactured by SHOWA DENKO K.K.). Among these, pentaerythritol tetrakis(3-mercaptobutylate) is preferable from the viewpoints of having less bad odor and the like. With regard to the number of functional groups of the thiol compound, three or more functional groups are preferable and four or more functional groups are more preferable, from the viewpoints of curability and the like.

A content of the thiol compound in the toner is not particularly limited, and for example, is from 2% by weight to 20% by weight with respect to the total weight of the toner. When the content of the thiol compound in the toner is less than 2% by weight, insufficient curing may occur, and when the content of the thiol compound in the toner is greater than 20% by weight, blocking resistance may deteriorate due to unreacted thiol.

The photopolymerization initiator is not particularly limited, and examples thereof include radical polymerization initiators including acetophenone-based initiators such as IRGACURE 184 (phenyl 1-hydroxycyclohexyl ketone), IRGACURE 819 (phenyl bis(2,4,6-trimethyl benzoyl)phosphine oxide), IRGACURE 907 (2-methyl-1-[4-(methylthio) phenyl]-2-morpholino-1-propanone), IRGACURE 369 (2-benzyl-2-(dimethylamino)-1-(4-morpholinophenyl)-1-butan one), and IRGACURE 1173 (2-hydroxy-1-phenyl ethanone), all of which are manufactured by BASF Japan Ltd. Among these, IRGACURE 819 is preferable from the viewpoints of curability and the like.

A content of the photopolymerization initiator in the toner is not particularly limited, and for example, is from 1% by weight to 10% by weight with respect to the total weight of the toner. When the content of the photopolymerization initiator in the toner is less than 1% by weight, insufficient curing may occur, and when the content of the photopolymerization initiator in the toner is greater than 10% by weight, insufficient curing may occur.

The toner according to the exemplary embodiment may further include another resin in addition to the crystalline polyester resin having an unsaturated double bond. Another resin is not particularly limited and examples thereof include polyester, polystyrene, styrene-acrylic resin such as a styrene-alkyl acrylate copolymer or a styrene-alkyl methacrylate copolymer, a styrene-acrylonitrile copolymer, a styrene-butadiene copolymer, a styrene-maleic anhydride copolymer, polyethylene, and polypropylene. Furthermore, other examples thereof include polyurethane, epoxy resin, silicone resin, polyamide, modified rosin, and paraffin wax. The content of another resin in the toner is not particularly limited, and for example, is from 1% by weight to 20% by weight with respect to the total weight of the toner.

Hereinafter, other components of the toner according to the exemplary embodiment will be described.

Optionally, the toner according to the exemplary embodiment may include other additives such as a colorant, a release agent, a charge-controlling agent, silica powder, and a metal oxide. These additives may be internally added by, for example, kneading the additives into a binder resin or may be externally added by, for example, obtaining toner particles first and mixing the additives with the toner particles. In general, the colorant is included, but when a transparent toner is desired, the colorant may not be included.

The colorant is not particularly limited and well-known pigments or dyes may be used. Specifically, the following respective pigments of yellow, magenta, cyan, and black are used.

Representative examples of the yellow pigments include condensed azo compounds, isoindolinone compounds, anthraquinone compounds, azo metal complex compounds, methine compounds, and allylamide compounds.

Examples of the magenta pigments include condensed azo compounds, diketo-pyrrolo-pyrrole compounds, anthraquinone compounds, quinacridone compounds, basic dye lake compounds, naphthol compounds, benzimidazolone compounds, thioindigo compounds, and perylene compounds.

Examples of the cyan pigments include copper phthalocyanine compounds and derivatives thereof, anthraquinone compounds, and basic dye lake compounds.

Examples of the black pigments include carbon black, aniline black, acetylene black, and iron black.

The release agent is not particularly limited, and examples thereof include plant waxes such as carnauba wax, vegetable wax, and rice bran wax; animal waxes such as honey wax, insect wax, whale wax, and wool wax; montan wax; mineral wax such as ozokerite; Fischer-Tropsch wax (FT wax) having ester in the side chain; solid waxes of synthetic fatty acid esters such as special fatty acid ester and polyol ester; and synthetic waxes such as paraffin wax, polyethylene wax, polypropylene wax, polytetrafluoroethylene wax; polyamide wax, and silicone compound. As the release agent, the above examples may be used alone or in a combination of two or more kinds.

The charge-controlling agent is not particularly limited and well-known charge-controlling agents are used. Examples thereof include positive charge-controlling agents such as nigrosine dyes, fatty acid-modified nigrosine dyes, carboxyl group-containing fatty acid modified nigrosine dyes, quaternary ammonium salts, amine compounds, amide compounds, imide compounds, and organic metal compounds; and negative charge-controlling agents such as metal complexes of oxycarboxylic acid, metal complexes of azo compounds, metal complex salt dyes, and salicylic acid derivatives. As the charge-controlling agent, the above examples may be used alone or in combination of two or more kinds.

The metal oxide is not particularly limited, and examples thereof include titanium oxide, aluminum oxide, magnesium oxide, zinc oxide, strontium titanate, barium titanate, magnesium titanate, and calcium titanate. As the metal oxide, the above examples may be used alone or in combination of two or more kinds.

Preparation Method of Toner

A preparation method of the toner according to the exemplary embodiment is not particularly limited and for example, the toner may be prepared using a pulverizing method or an emulsifying-in-liquid-and-drying method. In addition, for example, a toner prepared in the pulverizing method or in the emulsifying-in-liquid-and-drying method may be pulverized in a carrier solution.

Specifically, there are dry methods and wet methods. Examples of dry methods include a kneading and pulverizing method in which a binder resin, and optionally, a colorant, and a release agent, a charge-controlling agent and the like are kneaded, pulverized, and classified; and a method in which the shapes of particles obtained using the kneading and pulverizing method are changed by mechanical impact or heat energy. Examples of wet methods include an emulsification polymerization aggregation method in which a dispersion obtained by emulsifying and polymerizing polymerizable monomers of a binder resin and optionally, a dispersion of a colorant, a release agent, a charge-controlling agent, and the like are mixed, aggregated, heated, and coalesced to obtain toner base particles; a suspension polymerization method in which polymerizable monomers for obtaining a binder resin and optionally, a solution having a colorant, a release agent, a charge-controlling agent, and the like are suspended in an aqueous solvent and polymerized; and a dissolving suspension method in which a binder resin and optionally, a solution having a colorant, a release agent, a charge-controlling agent and the like are suspended in an aqueous solvent for granulation.

For example, the polyester resin having an unsaturated double bond and optionally, another resin, the colorant, other additives, and the like are put into a mixing device such as a Henschel mixer and mixed. Then, the mixture is melt-kneaded in a twin screw extruder, a Banbury mixer, a roll mill, a kneader, or the like, cooled using a drum flaker or the like, coarsely pulverized using a pulverizer such as a hammer mill, finely pulverized using a pulverizer such as a jet mill, and classified using a wind classifier. As a result, a toner is obtained in the pulverizing method.

In addition, the polyester resin having an unsaturated double bond and optionally, another resin, the colorant, other additives, and the like are dissolved in a solvent such as ethyl acetate, and emulsified and suspended in water to which a dispersion stabilizer such as calcium carbonate is added. After the solvent is removed, particles obtained by removing the dispersion stabilizer are filtered and dried. As a result, a toner is obtained in the emulsifying-in-liquid-and-drying method.

In addition, when the toner is obtained, the mixing ratio of the respective materials (the resins, the colorant, other additives, and the like) may be set in consideration of required characteristics, a low-temperature fixing property, color and the like. The obtained toner is pulverized in carrier oil using a well-known pulverizer such as a ball mill, a bead mill, and a high-pressure wet atomizer. As a result, toner particles for liquid developer are obtained.

For example, the thiol compound and the photopolymerization initiator are added to the toner thus obtained, followed by dispersion in a solvent such as alcohol (for example, methanol). Then, the solvent is removed through reduction in pressure and the like. As a result, a curable toner is obtained.

In order to obtain a toner having GSDp of 1.35 or less and GSDv of 1.35 or less, the toner may be prepared with, for example, the following method. The unsaturated crystalline polyester, the colorant, the thiol compound, and the photopolymerization initiator are added to a solvent such as methyl ethyl ketone and are dissolved therein under heating conditions such as a reflux temperature. While maintaining this temperature, heated ammonia water and the like are added thereto and heated water is added thereto, followed by phase transfer emulsification. As a result, fine particles are obtained. Next, a surfactant such as a nonionic surfactant is added to stabilize the fine particles. After cooling, water is added and a coagulant such as an aqueous sodium sulfate solution is added. Then, water is added to stop the reaction. Next, water is added while removing the solvent, this dispersion is centrifugally separated, the supernatant liquid is discarded, and a process of washing the resultant with water is repeated once or more. Precipitated particles are separated by filtration; and the obtained cake is dried by freeze-drying or the like to obtain a toner.

Properties of Toner

The volume average particle size D50v of the toner is preferably from 0.5 μm to 6.0 μm. In the above-described range, adhesion increases and developability is improved. In addition, the resolution of an image is also improved. The volume average particle size D50v of the toner is more preferably from 0.8 μm to 5.0 μm and still more preferably from 1.0 μm to 4.0 μn.

The volume average particle size D50v, the number average particle size distribution index (GSDp), the volume average particle size distribution index (GSDv), and the like of the toner are measured using a laser diffraction/scattering particle size distribution analyzer such as LA920 (manufactured by Horiba Ltd.). The cumulative distributions of particle sizes from a smaller particle size side in terms of volume and number are drawn in a particle size range (channel) which is divided based on the particle size distribution. A particle size which is an accumulated value of 16% is defined as Volume D16v and Number D16p, a particle size which is an accumulated value of 50% is defined as Volume D50v and Number D50p, and a particle size which is an accumulated value of 84% is defined as Volume D84v and Number D84p. Using these, the volume average particle size distribution index (GSDv) is calculated according to an expression of $(D50v/D84v)^{1/2}$ and the number average particle size distribution index (GSDp) is calculated according to an exemplary embodiment, it is preferable that GSDp be less than or equal to 1.35 and GSDv be less than or equal to 1.35, and it is more preferable that GSDp be less than or equal to 1.32 and GSDv be less than or equal to 1.30. When GSDp is less than or equal to 1.35 and GSDv is less than or equal to 1.35, it is considered that the toner is easily fused during fixing, reactivity with the thiol compound is improved, crosslinking performance is improved, and scratch resistance is improved. When GSDp and GSDv are out of the above-described range, there may be a case in which it is difficult to fuse aggregated toner particles during fixing, reactivity with the thiol compound deteriorates, crosslinking performance deteriorates, and scratch resistance deteriorates.

Liquid Developer

A liquid developer according to the exemplary embodiment includes the above-described toner and a carrier solution. In a liquid developer using a carrier solution such as non-volatile paraffin oil, the carrier solution remains in a fixed image. As a result, the carrier solution and the binder resin of the toner have affinity to each other, which is likely to lead to blocking. In the exemplary embodiment, the toner includes the polyester resin having an unsaturated double bond, the thiol compound having a bi- or more-functional thiol group, and the photopolymerization initiator; and an image is cured by the photopolymerization of the unsaturated double bond of the polyester resin and the thiol group of the thiol compound with low oxygen inhibition. As a result, it is considered that an image is sufficiently cured even in the atmosphere and have superior scratch resistance even in the presence of a carrier solution. Using an ene-thiol reaction, an image has less curing shrinkage and is sufficiently cured in the atmosphere.

Carrier Solution

The carrier solution is an insulating liquid for dispersing the toner and is not particularly limited. Examples thereof include aliphatic hydrocarbon solvents including an aliphatic hydrocarbon such as paraffin oil as the main component (Examples of commercial products thereof include MORESCO WHITE MT-30P, MORESCO WHITE P40, and MORESCO WHITE P70 (all of which are manufactured by MATSUMURA OIL Co., Ltd.) and ISOPAR L and ISOPAR M (both of which are manufactured by Exxon Mobil Corporation)); and hydrocarbon solvents such as naphthenic oil (Examples of commercial products thereof include EXXSOL D80, EXXSOL D110, and EXXSOL D130 (all of which are manufactured by Exxon Mobil Corporation) and NAPHTHESOL L, NAPHTHESOL M, NAPHTHESOL H, NEW NAPHTHESOL 160, NEW NAPHTHESOL 200, NEW NAPHTHESOL 220, and NEW NAPHTHESOL MS-20P (all of which are manufactured by Nippon Petro Chemicals Co., Ltd)). Among these, the aliphatic hydrocarbon solvents including an aliphatic hydrocarbon as the main component are preferable and solvents of linear or branched aliphatic hydrocarbon having 6 to 15 carbon atoms are more preferable, from the viewpoint that the initiator or the thiol compound in the toner is insoluble therein.

As the carrier solution included in the liquid developer according to the exemplary embodiment, the above examples may be used alone or in combination of two or more kinds. Examples of the combination of two or more kinds of the carrier solution include a mixture of a paraffin solvent and vegetable oil and a mixture of a silicone solvent and vegetable oil.

The volume resistivity of the carrier solution is, for example, from $1.0\times10^{10}$ Ω·cm to $1.0\times10^{14}$ Ω·cm and may be from $1.0\times10^{10}$ Ω·cm to $1.0\times10^{13}$ Ω·cm.

The carrier solution may include secondary materials such as a dispersant, an emulsifier, a surfactant, a stabilizer, a wetting agent, a thickener, a foaming agent, an antifoaming agent, a coagulant, a gelling agent, an anti-settling additive, a charge-controlling agent, an anti-static additive, an age resister, a softener, a plasticizer, a filler, an odorant, an anti-tack agent, a release agent, and a radical scavenger. In particular, it is preferable that the carrier solution include N-PAL, hydroquinone, or the like which is a radical scavenger, from the viewpoints of preservation stability and the like.

Preparation Method of Liquid Developer

The liquid developer according to the exemplary embodiment is obtained by mixing and pulverizing the toner and the carrier solution using a disperser such as a ball mill, a sand mill, an attritor, or a bead mill to disperse the toner in the carrier solution. A method of dispersing the toner in the carrier solution is not limited to the disperser. The dispersion may be performed by high-speed rotation of a special stirring blade as in the case of a mixer, shearing force of a rotor-stator known as a homogenizer, or ultrasonic waves.

The concentration of the toner in the carrier solution is preferably from 0.5% by weight to 40% by weight and more preferably from 1% by weight to 30% by weight, from the viewpoints of appropriate control of the viscosity of the developer and smooth circulation of the developer in a developing unit.

Then, the obtained dispersion may be filtered using a filter such as a membrane filter with, for example, a pore size of about 100 μm to remove dirt, coarse particles, and the like.

Dry Developer

In the exemplary embodiment, a dry developer is not particularly limited as long as it includes the toner according to the exemplary embodiment, and the composition thereof may be appropriately selected according to the purpose. The dry developer according to the exemplary embodiment is a single component developer when only the toner is used or a two-component developer when the toner is used in combination with a carrier.

For example, when the toner is used in combination with a carrier, the carrier is not particularly limited, and well-known carriers such as resin-coated carriers which are disclosed in, for example, JP-A-62-39879 and JP-A-56-11461 may be used.

Specific examples of the carrier include the following resin-coated carriers. Examples of core particles of the carrier include well-known particles made of iron powder, ferrite, and magnetite, and the volume average particle size thereof is approximately from 30 μm to 200 μm.

In addition, examples of a coating resin of the resin-coated carrier include homopolymers or copolymers of two or more monomers of styrenes such as styrene, parachlorostyrene, and α-methyl styrene; α-methylene fatty acid monocarboxylic acids such as methyl acrylate, ethyl acrylate, n-propyl acrylate, lauryl acrylate, 2-ethylhexyl acrylate, methyl methacrylate, n-propyl methacrylate, lauryl methacrylate, and 2-ethylhexyl methacrylate; nitrogen-containing acryls such as dimethylaminoethyl methacrylate; vinyl nitriles such as acrylonitrile and methacrylonitrile; vinyl pyridines such as 2-vinyl pyridine and 4-vinyl pyridine; vinyl ethers such as vinyl methyl ether and vinyl isobutyl ether; vinyl ketones such as vinyl methyl ketone, vinyl ethyl ketone, and vinyl isopropenyl ketone; olefins such as ethylene and propylene; and vinyl fluorine-containing monomers such as fluorinated vinylidene, tetrafluoroethylene, and hexafluoroethylene; silicone resins containing methyl silicone and methyl phenyl silicone, and the like; polyesters containing bisphenol, glycol, and the like; epoxy resins; polyurethane resins; polyimide resins; cellulose resins; polyether resins; and polycarbonate resins. These resins may be used alone or in combination of two or more kinds. The coating amount of the coating resin is preferably from 0.1 part by weight to 10 parts by weight and more preferably from 0.5 part by weight to 3.0 parts by weight, with respect to the 100 parts by weight of the core particles.

For the preparation of the carrier, a heating kneader, a heating Henschel mixer, a UM mixer, or the like may be used, and depending on the amount of the coating resin, a heating fluidized rolling bed, a heating kiln, and the like may be used.

The mixing ratio of the toner and the carrier according to the exemplary embodiment in the dry developer is not particularly limited and may be appropriately selected according to the purpose.

Developer Cartridge, Process Cartridge, and Image Forming Apparatus

For example, an image forming apparatus according to the exemplary embodiment include an image holding member (hereinafter, sometimes referred to as "the photoreceptor"); a charging unit that charges a surface of the image holding member; a latent image forming unit that forms a latent image (an electrostatic latent image) on the surface of the image holding member; a developing unit that develops the latent image, which is formed on the surface of the image holding member, using the liquid developer according to the exemplary embodiment, to form a toner image; a transfer unit that transfers the toner image, which is formed on the surface of the image holding member, onto a recording medium; a fixing unit that forms a fixed image by fixing the toner image, which is transferred onto the recording medium, on the recording medium; and a curing unit that cures the fixed image.

In the image forming apparatus, for example, a portion including the developing unit may have a cartridge structure (process cartridge) which is detachable from the image forming apparatus main body. This process cartridge is not particularly limited as long as it accommodates the liquid developer or the dry developer according to the exemplary embodiment. For example, the process cartridge accommodates the liquid developer or the dry developer according to the exemplary embodiment; includes the developing unit that develops the latent image, which is formed on the surface of the image holding member, using the liquid developer or the dry developer, to form a toner image; and is detachable from the image forming apparatus.

In addition, a developer cartridge according to the exemplary embodiment is not particularly limited as long as it accommodates the liquid developer or the dry developer according to the exemplary embodiment. For example, the developer cartridge accommodates the liquid developer or the dry developer according to the exemplary embodiment; includes the developing unit that forms a toner image by developing the latent image, which is formed on the surface of the image holding member, using the liquid developer or the dry developer; and is detachable from the image forming apparatus.

Hereinafter, an example of an image forming apparatus according to the exemplary embodiment using the liquid developer will be described with reference to the drawing.

FIG. 1 is a diagram schematically illustrating a configuration example of the image forming apparatus according to the exemplary embodiment. An image forming apparatus 100 includes a photoreceptor (image holding member) 10, a charging device (charging unit) 20, an exposure device (latent image forming unit) 12, a developing device (developing unit) 14, an intermediate transfer medium (transfer unit) 16, a cleaner (cleaning unit) 18, a transfer fixing roller (transfer unit and fixing unit) 28, and a curing device (curing unit) 32. The photoreceptor 10 has a cylindrical shape. In the outer circumference of the photoreceptor 10, the charging device 20, the exposure device 12, the developing device 14, the intermediate transfer medium 16, and the cleaner 18 are provided in this order.

Hereinafter, the operations of this image forming apparatus 100 will be described.

The charging device 20 charges the surface of the photoreceptor 10 to a predetermined potential (charging process). Then, the exposure device 12 exposes the charged surface to, for example, laser beams on the basis of image signals to form a latent image (an electrostatic latent image) (latent image forming process).

The developing device 14 includes a developing roller **14*a* and a developer container 14*b*. The developing roller 14*a* is provided such that a part thereof is dipped in the liquid developer 24 accommodated in the developer container 14*b*. The liquid developer 24** includes the insulating carrier solution, the toner containing the binder resin and the charge-controlling agent.

The toner is dispersed in the liquid developer 24. Furthermore, for example, by continuously stirring the liquid developer 24 with a stirring member provided inside the developer container **14*b*, the variation of the toner concentration in the liquid developer 24 depending on positions is reduced. As a result, the liquid developer 24, in which the variation of toner concentration is reduced, is supplied to the developing roller 14*a*** which rotates in a direction indicated by arrow A in the drawing.

The liquid developer 24 which is supplied to the developing roller **14*a* is transported to the photoreceptor 10 in a state where the supply amount is restricted to a certain amount by a restricting member; and is supplied to an electrostatic latent image at a position where the developing roller 14*a* and the photoreceptor 10 are close to (or in contact with) each other. As a result, the electrostatic latent image is developed to form a toner image 26** (developing process).

The developed toner image 26 is transported to the photoreceptor 10 which rotates in a direction indicated by arrow B in the drawing and transferred to a paper (recording medium) 30. However, in the exemplary embodiment, in order to improve the transfer efficiency of the toner image from the photoreceptor 10 to the recording medium including the separation efficiency from the photoreceptor 10 and furthermore to perform the transferring and fixing of the toner image onto the recording medium at the same time, the toner image is temporarily transferred onto the intermediate transfer medium 16 before transferred onto the paper 30 (intermediate transfer process). At this time, there may be the difference between the circumferential speeds of the photoreceptor 10 and the intermediate transfer medium 16.

Next, the toner image, which is transported by the intermediate transfer medium 16 in a direction indicated by arrow C, is transferred and fixed onto the paper 30 at a position in contact with the transfer and fixing roller 28 (transfer process and fixing process). The paper 30 is sandwiched between the transfer and fixing roller 28 and the intermediate transfer medium 16 such that the toner image on the intermediate transfer medium 16 is in close contact with the paper 30. Accordingly, the toner image is transferred onto the paper 30 and the toner image on the paper is fixed. As a result, a fixed image 29 is obtained. The transfer and fixing roller 28 is preferably provided with a heating element such that the toner image is fixed by pressure and heat. In general, the fixing temperature is from 120° C. to 200° C.

When the intermediate transfer medium 16 is a roller type as shown in FIG. 1, a roller pair is formed with the transfer and fixing roller 28. Therefore, the intermediate transfer medium 16 and the transfer and fixing roller 28 respectively correspond to a fixing roller and a pressing roller in a fixing device and thus fulfills a fixing function. That is, when the paper 30 passes through a nip portion formed between the intermediate transfer medium 16 and the transfer and fixing roller 28, the toner image is heated and pressed against the intermediate transfer medium 16 by the transfer and fixing roller 28 while being transferred onto the intermediate transfer medium 16. Accordingly, the binder resin in the toner which configures the toner image is softened and the toner image is infiltrated into fibers of the paper 30. As a result, the fixed image 29 is formed on the paper 30.

In the exemplary embodiment, the transferring and fixing of the toner image onto the paper 30 are performed at the same time. However, the fixing process may be performed after the transfer process independently of each other. In this case, the transfer roller which transfers the toner image from the photoreceptor 10 onto the recording medium has a function corresponding to that of the intermediate transfer medium 16.

Next, the fixed image is cured by the curing device 32 (curing process). Curing is performed by the irradiation of ultraviolet rays (UV) or electromagnetic waves such as electron beams. Examples of the curing device 32 include a UV irradiation device and an electron beam irradiation device.

Meanwhile, in the photoreceptor 10 which has transferred the toner image 26 onto the intermediate transfer medium 16, a toner which remains thereon without being transferred is transported to a position in contact with the cleaner 18 and collected by the cleaner 18. When the transfer efficiency approaches 100% and there is no problem with a remaining toner, the cleaner 18 may not be provided.

The image forming apparatus 100 may include an erasing device (not shown) which erases the charge on the surface of the photoreceptor 10 after transferring and before subsequent charging.

All of the charging device 20, the exposure device 12, the developing device 14, the intermediate transfer medium 16, the transfer and fixing roller 28, the curing device 32, the cleaner 18, and the like which are included in the image forming apparatus 100, may operate in synchronization with the rotating speed of the photoreceptor 10.

When the dry developer is used, the developing unit has a function of forming the toner image by developing the electrostatic latent image, which is formed on the photoreceptor 10, using the single-component developer or two-component developer containing the toner. Such a developing device is not particularly limited as long as it has the above-described function, and may be appropriately selected depending on the purposes: a type in which a toner layer is in contact with the photoreceptor 10 or a type in which the toner layer is not in contact with the photoreceptor 10 may be selected. For example, well-known developer units such as a developer unit which has a function of attaching toner onto the photoreceptor 10 using a roller, a brush, or the like, are used.

The image forming apparatus according to the exemplary embodiment may include a transparent image forming unit that forms a transparent image on an image holding member, which includes a blanket, a transfer roller, and a transfer belt, using the toner according to the exemplary embodiment as a transparent toner; a color image forming unit that forms a color image (underlayer), which contains one or more color particles, on the transparent image; a transfer unit that transfers the formed images onto a recording medium; a fusing unit that fuses the transparent image on the recording medium; and a curing unit that cures the fused image by the irradiation of ultraviolet rays, heating, or the like.

It is considered that, by using the polyester resin having an unsaturated double bond, the thiol compound having a bi- or more-functional thiol group, and the photopolymerization initiator; an image is cured by the photopolymerization of the unsaturated double bond of the polyester resin and the thiol group of the thiol compound with low oxygen inhibition; and as a result, an image is sufficiently cured even in the atmosphere and has superior scratch resistance. Using an ene-thiol reaction, an image has less curing shrinkage and is sufficiently cured in the atmosphere.

EXAMPLES

Hereinafter, the exemplary embodiment will be described in detail with reference to Examples and Comparative Examples. However, the present invention is not limited to the following Examples.

Synthesis Example 1

Synthesis of Unsaturated Crystalline Polyester Resin 1

Trans-3-hexenedioic acid (45 parts by weight, manufactured by Tokyo Chemical Industry Co., Ltd.), 2-butene-1,4-diol (cis- and trans-mixture; 26 parts by weight, mol ratio cis:trans=28:72, manufactured by Tokyo Chemical Industry Co., Ltd.), and ORGATIX TC-400 (0.50 part by weight, manufactured by Matsumoto Fine Chemical Co., Ltd.) as a catalyst are put into a three-necked flask, followed by heating and stirring under nitrogen stream at 180° C. for 2 hours. Furthermore, heating and stirring is performed at 700 Pa and 180° C. for 4 hours. After the completion of the reaction, the reaction solution is poured into a beaker (630 parts by weight of methanol) and crystals are precipitated. These crystals are separated by filtration under reduced pressure and are washed with 400 parts by weight of methanol. These crystals are vacuum-dried at 30° C. for 18 hours. As a result, 47 parts by weight of unsaturated crystalline polyester resin 1 is obtained. The melting point is 71° C. The weight average molecular weight of this resin is 11,600 when measured at a flow rate of 1 mL/min using a gel permeation chromatography (GPC) LC-10AD (manufactured by Shimadzu Corporation) with a polystyrene calibration curve.

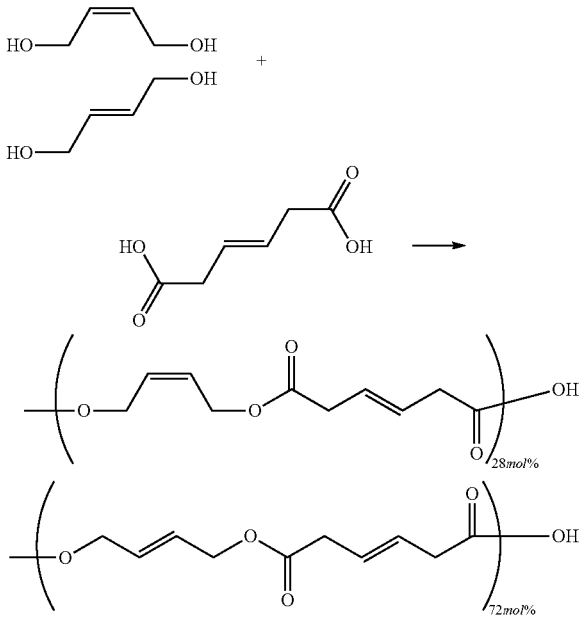

Synthesis Example 2

Synthesis of Unsaturated Crystalline Polyester Resin 2

Trans-3-hexenedioic acid (87 parts by weight, manufactured by Tokyo Chemical Industry Co., Ltd.), 2-butene-1,4-diol (cis- and trans-mixture; 53 parts by weight, mol ratio cis:trans=28:72, manufactured by Tokyo Chemical Industry Co., Ltd.), and ORGATIX TC-400 (1.0 part by weight, manufactured by Matsumoto Fine Chemical Co., Ltd.) are put into a three-necked flask, followed by heating and stirring under nitrogen stream at 180° C. for 2 hours. Furthermore, heating and stirring is performed at 230 Pa and 180° C. for 7 hours. After the completion of the reaction, the reaction solution is poured into a beaker (950 parts by weight of methanol) and crystals are precipitated. These crystals are separated by filtration under reduced pressure and are washed with 800 parts by weight of methanol. These crystals are dried in a vacuum at 30° C. for 18 hours. As a result, 100 parts by weight of unsaturated crystalline polyester resin 2 is obtained. The melting point is 71° C. The weight average molecular weight of this resin is 44,000.

Synthesis Example 3

Synthesis of Unsaturated Crystalline Polyester Resin 3

Trans-3-hexenedioic acid (3.0 parts by weight, manufactured by Wako Pure Chemical Industry Ltd.), cis-2-butene-1,4-diol (1.8 parts by weight, manufactured by Tokyo Chemical Industry Co., Ltd.), and ORGATIX TC-400 (0.033 part by weight, manufactured by Matsumoto Fine Chemical Co., Ltd.) are put into a three-necked flask, followed by heating and stirring under nitrogen stream at 180° C. for 4 hours. Furthermore, heating and stirring is performed at from 200 Pa to 700 Pa and 180° C. for 4 hours. After the completion of the reaction, the reaction solution is poured into a beaker (80 parts by weight of methanol) and crystals are precipitated. These crystals are separated by filtration under reduced pressure and are washed with 80 parts by weight of methanol. These crystals are dried in a vacuum at 20° C. for 18 hours. As a result, 70 parts by weight of unsaturated crystalline polyester resin 3 is obtained. The melting point is 48° C. The weight average molecular weight of this resin is 13,500.

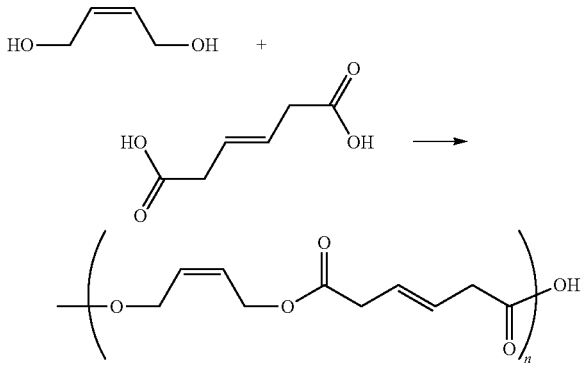

Synthesis Example 4

Synthesis of Unsaturated Crystalline Polyester Resin 4

Fumaric acid (61 parts by weight, manufactured by Wako Pure Chemical Industry Ltd.), cis-2-butene-1,4-diol (44 parts by weight, manufactured by Tokyo Chemical Industry Co., Ltd.), and ORGATIX TC-400 (0.80 part by weight, manufactured by Matsumoto Fine Chemical Co., Ltd.) are put into a three-necked flask, followed by heating and stirring under nitrogen stream at 180° C. for 2 hours. Furthermore, heating and stirring is performed at 700 Pa and 180° C. for 3 hours. After the completion of the reaction, the reaction solution is poured into a beaker (1200 parts by weight of methanol) and crystals are precipitated. These crystals are separated by filtration under reduced pressure and are washed with 400 parts by weight of methanol. These crystals are dried in a vacuum at 40° C. for 18 hours. As a result, 70 parts by weight of unsaturated crystalline polyester resin 4 is obtained. The melting point is 85° C. The weight average molecular weight of this resin is 10,200.

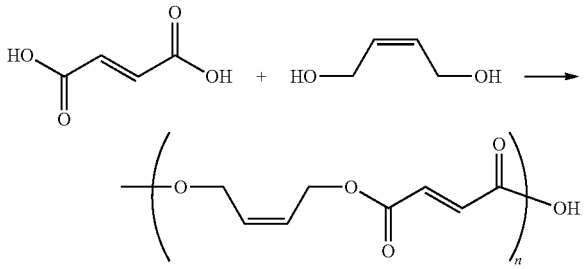

Synthesis Example 5

60 parts by weight of unsaturated crystalline polyester resin 5 is obtained with the same method as that of Synthesis Example 4, except that trans-3-hexenedioic acid is used instead of fumaric acid. The melting point is 45° C. The weight average molecular weight of this resin is 12,000.

Synthesis Example 6

62 parts by weight of unsaturated crystalline polyester resin 6 is obtained with the same method as that of Synthesis Example 4, except that 1,12-dodecanediol is used instead of cis-2-buten-1,4-diol. The melting point is 89° C. The weight average molecular weight of this resin is 8,900.

Synthesis Example 7

Fumaric acid (10 parts by weight, manufactured by Wako Pure Chemical Industry Ltd.), cis-4-cyclohexene-1,2-dicarboxylic acid (1.6 parts by weight, manufactured by Tokyo Chemical Industry Co., Ltd.), 1,6-hexanediol (11 parts by weight, manufactured by Tokyo Chemical Industry Co., Ltd.), and ORGATIX TC-400 (0.15 part by weight, manufactured by Matsumoto Fine Chemical Co., Ltd.) are put into a three-necked flask, followed by heating and stirring under nitrogen stream at 180° C. for 2 hours. Furthermore, heating and stirring is performed at 200 Pa and 180° C. for 3 hours. After the completion of the reaction, the reaction solution is poured into a beaker (100 parts by weight of methanol) and crystals are precipitated. These crystals are separated by filtration under reduced pressure and are washed with 100 parts by weight of methanol. These crystals are dried in a vacuum at 40° C. for 18 hours. As a result, 40 parts by weight of unsaturated crystalline polyester resin 7 is obtained. The melting point is 101° C. The weight average molecular weight of this resin is 13,200.

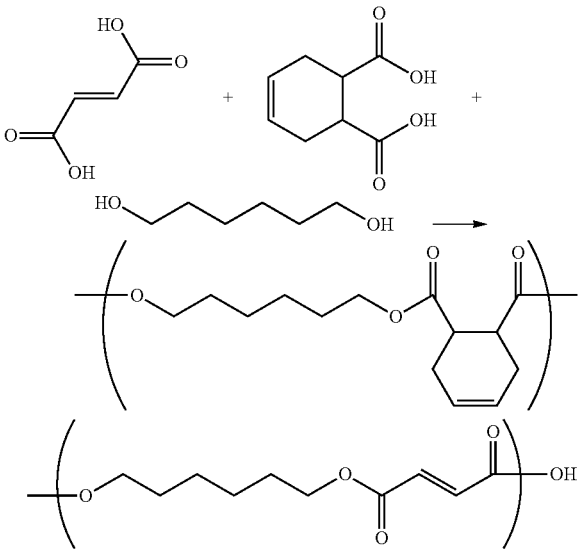

Synthesis Example 8

Synthesis of Unsaturated Crystalline Polyester Resin 8

Fumaric acid (58 parts by weight, manufactured by Wako Pure Chemical Industry Ltd.), 1,6-hexanediol (56 parts by weight, manufactured by Tokyo Chemical Industry Co., Ltd.), and ORGATIX TC-400 (0.70 part by weight, manufactured by Matsumoto Fine Chemical Co., Ltd.) are put into a three-necked flask, followed by heating and stirring under nitrogen stream at 180° C. for 2 hours. Furthermore, heating and stirring is performed at 700 Pa and 180° C. for 3 hours. After the completion of the reaction, the reaction solution is poured into a beaker (1200 parts by weight of methanol) and crystals are precipitated. These crystals are separated by filtration under reduced pressure and are washed with 400 parts by weight of methanol. These crystals are dried in a vacuum at 40° C. for 18 hours. As a result, 40 parts by weight of unsaturated crystalline polyester resin 8 is obtained. The melting point is 106° C. The weight average molecular weight of this resin is 8,200.

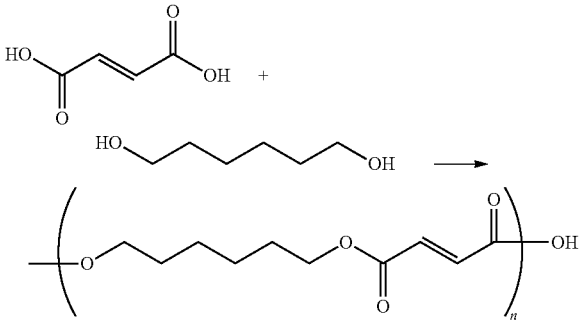

Synthesis Example 9

Synthesis of Unsaturated Crystalline Polyester Resin 9

Sebacic acid (64 parts by weight, manufactured by Wako Pure Chemical Industry Ltd.), 2-butene-1,4-diol (cis- and trans-mixture; 26 parts by weight, mol ratio cis:trans=32:68, manufactured by Tokyo Chemical Industry Co., Ltd.), and ORGATIX TC-400 (0.50 part by weight, manufactured by Matsumoto Fine Chemical Co., Ltd.) are put into a three-necked flask, followed by heating and stirring under nitrogen stream at 180° C. for 2 hours. Furthermore, heating and stirring is performed at from 200 Pa to 700 Pa and 180° C. for 3 hours. After the completion of the reaction, the reaction solution is poured into a beaker (600 parts by weight of methanol) and crystals are precipitated. These crystals are separated by filtration under reduced pressure and are washed with 240 parts by weight of methanol. These crystals are dried in a vacuum at 40° C. for 18 hours. As a result, 65 parts by weight of unsaturated crystalline polyester resin 9 is obtained. The melting point is 61° C. The weight average molecular weight of this resin is 9,500.

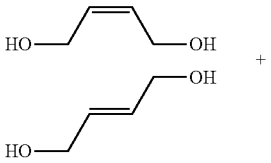

-continued

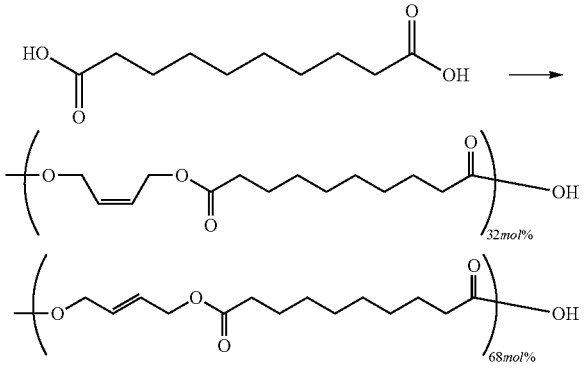

Example 1

Preparation of Developer 1

40 parts by weight of cyan pigment C.I. Pigment Blue 15:3 (manufactured by Clariant Japan K.K.) is added to 60 parts by weight of amorphous polyester resin (manufactured by The Nippon Synthetic Chemical Industry Co., Ltd., TP-235, weight average molecular weight: 16,000, glass transition temperature Tg: 65° C.), followed by kneading with a pressure kneader. The kneaded matter is coarsely pulverized and a cyan pigment master batch is prepared.

Next, a mixture having the following composition is put into a flask equipped with a stirring device and a cooling pipe, followed by dissolution and dispersion for 3 hours while heating the mixture at 80° C.

The above-mentioned cyan pigment master batch: 25 parts by weight

Unsaturated crystalline polyester resin 1: 75 parts by weight

Ethyl acetate: 240 parts by weight

Meanwhile, 200 parts by weight of calcium carbonate (LUMINOUS, manufactured by Maruo Calcium Co., Ltd.) as a dispersion stabilizer is added to an aqueous solution obtained by dissolving 200 parts by weight of sodium chloride (manufactured by Wako Pure Chemical Industry Ltd.) in 1350 parts by weight of ion exchange water, followed by dispersion with a ball mill for 24 hours. As a result, a dispersion medium is obtained. 1150 parts by weight of this dispersion medium is heated to 40° C.; and 270 parts by weight of the above-described mixture heated to 40° C. is added thereto, followed by emulsification with an emulsification device (HIGH-FLEX HOMOGENIZER ULTRA-TURRAX T-25, manufactured by TKA Japan K.K.) at 8000 rpm and 24000 rpm for 1 minute. As a result, a suspension is obtained.

The suspension is put into a separable flask which is equipped with a stirring device, a thermometer, a cooling pipe, and a nitrogen gas inlet pipe, followed by stirring at 20° C. for 5 hours while nitrogen gas is introduced through the nitrogen gas inlet pipe and ethyl acetate is removed. Then, an aqueous 10% hydrochloric acid solution is added to the reaction solution to decompose calcium carbonate, followed by centrifugal separation. The obtained particles are washed with 1000 parts by weight of ion exchange water three times. The obtained particles are vacuum-dried at 40° C.

A mixture of 103 parts by weight of ISOPAR L (manufactured by Exxon Mobil Corporation) as a carrier solution and 1.5 parts by weight of SOLSPERSE 13940 (manufactured by The Lubrizol Corporation) as a dispersant is added to 35 parts by weight of the dried cyan particles and the resultant is pulverized with a ball mill. As a result, a dispersion containing toner particles with a volume average particle size of 10.0 μm is obtained.

5 parts by volume of liquid thiol compound (manufactured by Showa Denko K.K., trade name: KARENZ MTPE-1, tetrafunctional, pentaerythritol-based, 20 vol % methanol solution) and 20 parts by volume of 4 vol % methanol solution of the photopolymerization initiator (manufactured by BASF Japan Ltd., trade name: IRGACURE 819) are added to the dispersion, followed by dispersion for 10 minutes using an ultrasonic cleaner (manufactured by AS ONE Corporation, Model No. US-3R). Then, methanol is removed by reduction in pressure. As a result, a liquid developer 1 is obtained.

Toner particles may be collected from the liquid developer with the following method. The liquid developer is precipitated by centrifugal separation (1,000 rpm×5 minutes), the supernatant liquid is removed by decantation, and toner particles are extracted. The extracted toner particles are washed with hexane, ISOPAR, or the like (a mixed solvent may be appropriately changed according to a toner resin).

Example 2

Preparation of Curable Toner 1

A curable toner 1 is obtained by centrifugally separating ISOPAR L of the developer 1 obtained in Example 1 for solid-liquid separation; and then vacuum-drying the separated toner particles at 20° C.

Example 3

Preparation of Developer 3

A liquid developer 3 is obtained with the same method as that of the developer 1 in Example 1, except that the unsaturated crystalline polyester resin 4 is used instead of the unsaturated crystalline polyester resin 1.

Example 4

Preparation of Curable Toner 2

3.8 parts by weight of the unsaturated crystalline polyester resin 2, the aqueous cyan pigment dispersion (2.0 parts by weight, solid content concentration: 27% by weight), KARENZ MPTE-1 (0.54 part by weight, manufactured by Showa Denko K.K.) as the thiol compound, and IRGACURE 819 (0.54 part by weight, manufactured by BASF Japan Ltd.) as the photopolymerization initiator are put into a separable flask; and methyl ethyl ketone (8.0 parts by weight, manufactured by Kanto Chemical Co., Inc.) is added, followed by dissolution at a reflux temperature. While maintaining this temperature, 3.3 parts by weight of 1N ammonia water heated to 50° C. is added dropwise; and 19.6 parts by weight of water heated to 50° C. is added dropwise, followed by phase-transfer emulsification. As a result, fine particles are obtained. Next, 2.7% PELLEX CS (nonionic surfactant, 2.0 part by weight, manufactured by Kao corporation) as a surfactant is added for stabilization. The resultant is cooled to 30° C., and 10 parts by weight of water is added thereto. 18.0 parts by weight of 5% aqueous sodium sulfate solution as a coagulant is added dropwise. Then, 40 parts by weight of water is added to stop the reaction. Next, methyl ethyl ketone as the solvent is removed while blowing air at 25° C. 200 parts by weight of water is added while removing the solvent. This dispersion is centrifugally separated at 3000 rpm for 20 minutes, and the supernatant liquid is discarded. 300 parts by weight of water is added to the precipitated particles, followed by washing for 10 minutes while performing stirring with ultrasonic waves. After washing, centrifugal separation is performed at 3000 rpm for 30 minutes, and the supernatant liquid is discarded. This washing process is repeated twice. 100 parts by weight of water is added to the precipitated particles, the resultant is stirred by ultrasonic waves for 10 minutes, and is separated by filtration under reduced pressure. After washing by pouring 100 parts by weight of water, these particles are dried by freeze-drying for 20 hours. As a result, 4.5 parts by weight of curable toner 2 (volume average particle size Dv50: 3.8 μm, GSDv: 1.33, GSDp: 1.27) is obtained.

Example 5

Preparation of Developer 5

ISOPAR L (8.0 parts by weight, manufactured by Exxon Mobil Corporation) is added to 2.0 parts by weight of the curable toner 2 in Example 4. As a result, a liquid developer 5 is prepared.

Example 6

Preparation of Developer 6

A liquid developer 6 is prepared with the same method as that of the developer 1 in Example 1, except that the unsaturated crystalline polyester resin 3 is used instead of the unsaturated crystalline polyester resin 1.

Example 7

Preparation of Developer 7

A liquid developer 7 is prepared with the same method as that of the developer 1 obtained in Example 1, except that a thiol compound (manufactured by Showa Denko K.K., trade name: KARENZ MTNR-1, trifunctional, triazine-based) is used instead of the liquid thiol compound (KARENZ MTPE-1).

Example 8

Preparation of Developer 8

A liquid developer 8 is prepared with the same method as that of the developer 1 obtained in Example 1, except that a thiol compound (manufactured by Showa Denko K.K., trade name: KARENZ MTBD-1, bifunctional) is used instead of the liquid thiol compound (KARENZ MTPE-1).

Example 9

Preparation of Developer 9

4.6 parts by weight of liquid developer 9 is prepared with the same method of Example 4, except that the amount of the 5% aqueous sodium sulfate solution in Example 4 is changed to 16 parts by weight. In this liquid developer, the volume average particle size Dv50 is 3.3 μm, GSDv is 1.30, and GSDp is 1.45.

Example 10

Preparation of Developer 10

4.3 parts by weight of liquid developer 10 is prepared with the same method of Example 4, except that the amount of the 5% aqueous sodium sulfate solution in Example 4 is changed to 20 parts by weight. In this liquid developer, the volume average particle size Dv50 is 4.0 μm, GSDv is 1.37, and GSDp is 1.32.

Example 11

Preparation of Developer 11

4.0 parts by weight of liquid developer 11 is prepared with the same method of Example 4, except that the amount of the 5% aqueous sodium sulfate solution in Example 4 is changed to 22 parts by weight. In this liquid developer, the volume average particle size Dv50 is 4.5 μm, GSDv is 1.42, and GSDp is 1.37.

Example 12

Preparation of Developer 12

A liquid developer 12 is obtained with the same method as that of the developer 1 in Example 1, except that the unsaturated crystalline polyester resin 5 is used instead of the unsaturated crystalline polyester resin 1.

Example 13

Preparation of Developer 13

A liquid developer 13 is obtained with the same method as that of the developer 1 in Example 1, except that the unsaturated crystalline polyester resin 6 is used instead of the unsaturated crystalline polyester resin 1.

Example 14

Preparation of Developer 14

A liquid developer 14 is obtained with the same method as that of the developer 1 in Example 1, except that the unsaturated crystalline polyester resin 7 is used instead of the unsaturated crystalline polyester resin 1.

Example 15

Preparation of Developer 15

A liquid developer 15 is obtained with the same method as that of the developer 1 in Example 1, except that the unsaturated crystalline polyester resin 8 is used instead of the unsaturated crystalline polyester resin 1.

Example 16

Preparation of Developer 16

A liquid developer 16 is obtained with the same method as that of the developer 1 in Example 1, except that the unsaturated crystalline polyester resin 9 is used instead of the unsaturated crystalline polyester resin 1.

Comparative Example 1

Preparation of Developer 17

40 parts by weight of cyan pigment C.I. Pigment Blue 15:3 (manufactured by Clariant Japan K.K.) as a colorant is added to 60 parts by weight of styrene-based thermoplastic resin (manufactured by FUJIKURA KASEI CO., LTD, trade name: FSR-051, weight average molecular weight: 390,000), followed by kneading with a pressure kneader. The kneaded matter is coarsely pulverized and a cyan pigment master batch is prepared.

Next, a mixture having the following composition is kneaded again using a pressure kneader.

The above-mentioned cyan pigment master batch: 25 parts by weight

Styrene-based thermoplastic resin (vinyl resin, manufactured by FUJIKURA KASEI CO., LTD, trade name: FSR-053, weight average molecular weight: 320,000): 55 parts by weight Styrene-based thermoplastic elastomer (resin having an unsaturated double bond, manufactured by Asahi Kasei Chemicals Corporation, trade name: ASAPRENE T439, styrene-butadiene block copolymer, styrene:butadiene ratio (mole)=45:55): 20 parts by weight The kneaded matter is pulverized using a jet mill. As a result, cyan particles 1 having a volume average particle size of 10 μm are obtained. A mixture of 103 parts by weight of ISOPAR L (manufactured by Exxon Mobil Corporation), which is non-aqueous and non-volatile as a carrier solution and 0.7 part by weight of SOLSPERSE 20000 (manufactured by The Lubrizol Corporation) as a dispersant is added to 35 parts by weight of the obtained cyan particles and the resultant is finely pulverized with a ball mill. 180 parts by weight of the above-described paraffin oil, 45 parts by weight of 40% by weight methanol solution of the liquid thiol compound (manufactured by Showa Denko K.K., trade name: KARENZ MTPE-1, tetrafunctional, pentaerythritol-based), and 10 parts by weight of 20% by weight methanol solution of the photopolymerization initiator (manufactured by BASF Japan Ltd., trade name: IRGACURE 819) are added thereto, followed by dispersion for 10 minutes using an ultrasonic cleaner (manufactured by AS ONE Corporation, Model No. US-3R). Then, methanol is removed by reduction in pressure. As a result, a liquid developer 17 containing toner particles with a volume average particle size of 1.3 μm is obtained.

Comparative Example 2

Preparation of Developer 18

100 parts by weight of ISOPAR L as a carrier solution is added to 30 parts by weight of cyan toner for DocuCentre Color 400 CP (manufactured by Fuji Xerox Co., Ltd.). 45 parts by weight of 40% by weight methanol solution of the liquid thiol compound (manufactured by Showa Denko K.K., trade name: KARENZ MTPE-1, tetrafunctional, pentaerythritol-based) and 10 parts by weight of 20% by weight methanol solution of the photopolymerization initiator (manufactured by BASF Japan Ltd., trade name: IRGACURE 819) are added, followed by dispersion for 10 minutes using an ultrasonic cleaner (manufactured by AS ONE Corporation, Model No. US-3R). Then, methanol is removed by reduction in pressure. As a result, a liquid developer 18 is obtained.

Comparative Example 3

Preparation of Developer 19

30 parts by weight of particles are obtained with the same method as that of Example 1 disclosed in Japanese Patent No. 4048942. Using these particles, a liquid developer 19 is prepared with the same method as that of Comparative Example 3.

Comparative Example 4

Preparation of Developer 20

40 parts by weight of cyan pigment C.I. Pigment Blue 15:3 (manufactured by Clariant Japan K.K.) is added to 60 parts by weight of amorphous polyester resin (manufactured by The Nippon Synthetic Chemical Industry Co., Ltd., TP-235, weight average molecular weight: 16,000, glass transition temperature Tg: 65° C.), followed by kneading with a pressure kneader. The kneaded matter is coarsely crushed and a cyan pigment master batch is prepared.

Next, a mixture having the following composition is put into a flask equipped with a stirring device and a cooling pipe, followed by dissolution and dispersion for 3 hours while heating the mixture at 80° C.

The above-mentioned cyan pigment master batch: 25 parts by weight

Amorphous polyester resin (manufactured by Kao Corporation): 75 parts by weight

Ethyl acetate: 240 parts by weight

Meanwhile, 200 parts by weight of calcium carbonate (LUMINOUS, manufactured by Maruo Calcium Co., Ltd.) as a dispersion stabilizer is added to an aqueous solution obtained by dissolving 200 parts by weight of sodium chloride (manufactured by Wako Pure Chemical Industry Ltd.) in 1350 parts by weight of ion exchange water, followed by dispersion with a ball mill for 24 hours. As a result, a dispersion medium is obtained. 1150 parts by weight of this dispersion medium is heated to 40° C.; and 270 parts by weight of the above-described mixture heated to 40° C. is added thereto, followed by emulsification with an emulsification device (HIGH-FLEX HOMOGENIZER ULTRA-TURRAX T-25, manufactured by TKA Japan K.K.) at 8000 rpm and 24000 rpm for 1 minute. As a result, a suspension is obtained.

The suspension is put into a separable flask which is equipped with a stirring device, a thermometer, a cooling pipe, and a nitrogen gas inlet pipe, followed by stirring at 20° C. for 5 hours while nitrogen gas is introduced through the nitrogen gas inlet pipe and ethyl acetate is removed. Then, an aqueous 10% hydrochloric acid solution is added to the reaction solution to decompose calcium carbonate, followed by centrifugal separation. The obtained particles are washed with 1000 parts by weight of ion exchange water three times. The obtained particles are vacuum-dried at 40° C.

A mixture of 103 parts by weight of ISOPAR L (manufactured by Exxon Mobil Corporation) as a carrier solution and 1.5 parts by weight of SOLSPERSE 13940 (manufactured by The Lubrizol Corporation) as a dispersant is added to 35 parts by weight of the dried cyan particles and the resultant is pulverized with a ball mill. As a result, a liquid developer containing toner particles with a volume average particle size of 8.0 μm is obtained.

5 parts by volume of liquid thiol compound (manufactured by Showa Denko K.K., trade name: KARENZ MTPE-1, 20 vol % methanol solution) and 20 parts by volume of 4 vol % methanol solution of photopolymerization initiator (manufactured by BASF Japan Ltd., trade name: IRGACURE 819) are added thereto, followed by dispersion for 10 minutes using an ultrasonic cleaner (manufactured by AS ONE Corporation, Model No. US-3R). Then, methanol is removed by reduction in pressure. As a result, a liquid developer 20 is prepared.

Comparative Example 5

Preparation of Developer 21

A liquid developer 21 is prepared with the same method as that of the developer 1 obtained in Example 1, except that a thiol compound (manufactured by Tokyo Chemical Industry Co., Ltd., trade name: 1-dodecanethiol, monofunctional) is used instead of the liquid thiol compound (KARENZ MTPE-1).

Evaluation for Low-Temperature Fixing Property

The minimum fixing temperature is evaluated at a point in which the haze value which is an index of transparency is less than or equal to 10. When an image is formed, heat is applied to the image stepwise; and the image is irradiated with ultraviolet rays as described above.

A: lower than 80° C.

B: 80° C. to lower than 90° C.

C: 90° C. or higher

Evaluation for Scratch Resistance

Scratch resistance is evaluated on a three with a method in which, when 5 different positions are scratched with a mechanical pencil H, cases where there are no changes are represented by "A"; and cases where one or more positions among the 5 positions are peeled off are represented by "B"; and cases where all the 5 positions are peeled off are represented by "C". The evaluation results are shown in Table 1.

Evaluation for Particle Size Distribution

The particle size distribution of the toner in each developer is measured with COULTER MULTISIZER 3 (manufactured by Beckman Coulter, Inc.) to obtain GSDp and GSDv.

TABLE 1

| | Material | | | | | | | Evaluation | |
|---|---|---|---|---|---|---|---|---|---|
| | Resin | m.p. (° C.) | Thiol Compound | Polymerization Initiator | Carrier Solution | GSDp | GSDv | Low-Temperature Fixing Property | Scratch Resistance |
| Example 1 | Crystalline PE 1 | 71 | MTPE-1 | IRGACURE 819 | ISOPAR L | 1.33 | 1.30 | A | A |
| Example 2 | Crystalline PE 1 | 71 | MTPE-1 | IRGACURE 819 | — | 1.33 | 1.30 | A | A |
| Example 3 | Crystalline PE 4 | 85 | MTPE-1 | IRGACURE 819 | ISOPAR L | 1.31 | 1.28 | A | A |
| Example 4 | Crystalline PE 2 | 71 | MTPE-1 | IRGACURE 819 | — | 1.27 | 1.33 | A | A |
| Example 5 | Crystalline PE 2 | 71 | MTPE-1 | IRGACURE 819 | ISOPAR L | 1.27 | 1.33 | A | A |
| Example 6 | Crystalline PE 3 | 48 | MTPE-1 | IRGACURE 819 | ISOPAR L | 1.29 | 1.28 | A | A |
| Example 7 | Crystalline PE 1 | 71 | MTNR-1 | IRGACURE 819 | ISOPAR L | 1.31 | 1.30 | A | A |
| Example 8 | Crystalline PE 1 | 71 | MTBD-1 | IRGACURE 819 | ISOPAR L | 1.30 | 1.28 | A | A |
| Example 9 | Crystalline PE 2 | 71 | MTPE-1 | IRGACURE 819 | ISOPAR L | 1.45 | 1.30 | B | B |
| Example 10 | Crystalline PE 2 | 71 | MTPE-1 | IRGACURE 819 | ISOPAR L | 1.32 | 1.37 | B | B |
| Example 11 | Crystalline PE 2 | 71 | MTPE-1 | IRGACURE 819 | ISOPAR L | 1.37 | 1.42 | B | B |
| Example 12 | Crystalline PE 5 | 45 | MTPE-1 | IRGACURE 819 | ISOPAR L | 1.31 | 1.29 | A | B |
| Example 13 | Crystalline PE 6 | 89 | MTPE-1 | IRGACURE 819 | ISOPAR L | 1.33 | 1.31 | A | A |
| Example 14 | Crystalline PE 7 | 101 | MTPE-1 | IRGACURE 819 | ISOPAR L | 1.32 | 1.31 | B | B |
| Example 15 | Crystalline PE 8 | 106 | MTPE-1 | IRGACURE 819 | ISOPAR L | 1.34 | 1.33 | B | B |
| Example 16 | Crystalline PE 9 | 61 | MTPE-1 | IRGACURE 819 | ISOPAR L | 1.29 | 1.29 | A | B |
| Comparative Example 1 | Styrene Acryl + SBS | — | MTPE-1 | IRGACURE 819 | ISOPAR L | 1.67 | 1.55 | C | B |
| Comparative Example 2 | Dry Toner | — | MTPE-1 | IRGACURE 819 | ISOPAR L | 1.30 | 1.30 | B | C |
| Comparative Example 3 | Toner of Example 1 described in Japanese Patent No. 4048942 | — | MTPE-1 | IRGACURE 819 | ISOPAR L | 1.32 | 1.38 | C | C |
| Comparative Example 4 | Toner for Dissolving Suspension Method | — | MTPE-1 | IRGACURE 819 | ISOPAR L | 1.55 | 1.65 | C | C |
| Comparative Example 5 | Crystalline PE 1 | 71 | 1-Dodecanethiol | IRGACURE 819 | ISOPAR L | 1.32 | 1.32 | B | C |

Image Formation

Each toner or liquid developer obtained in Examples and Comparative Examples is diluted with ISOPAR L such that the content of the toner particles is 2.5% by weight with respect to the total weight of the toner or liquid developer. A 3.5 cm×3.5 cm toner image (amount of toner particles deposited: 4 g/m$^2$) is formed on a membrane filter (manufactured by Millipore Corporation) under reduced pressure and is pressure-transferred onto an OHP film. As a result, an image is obtained. The image is heated on a hot plate at 80° C., 90° C., and 100° C., respectively, under conditions of an ultraviolet ray irradiation intensity of 6.4 mW/cm$^2$ and an ultraviolet ray irradiation time of 30 seconds (that is, an ultraviolet ray irradiation energy of 192 mJ/cm$^2$).

As described above, in Examples, an image having a superior low-temperature fixing property and superior scratch resistance is obtained as compared to Comparative Examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A toner comprising:

a crystalline polyester resin having an unsaturated double bond;

a thiol compound having a bi- or more-functional thiol group; and a photopolymerization initiator.

2. The toner according to claim 1, wherein the crystalline polyester resin is selected from the group consisting of a crystalline polyester resin obtained by polycondensating an unsaturated aliphatic dicarboxylic acid and an unsaturated aliphatic diol, a crystalline polyester resin obtained by polycondensating an unsaturated aliphatic dicarboxylic acid and an aliphatic diol, and a crystalline polyester resin obtained by polycondensating an aliphatic dicarboxylic acid and an unsaturated aliphatic diol.

3. The toner according to claim 1, wherein the toner has a GSDp represented by (16% number average particle size D16p/50% number average particle size D50p)$^{1/2}$ of less than or equal to 1.35, and a GSDv represented by (50% volume average particle size D50v/84% volume average particle size D84v)$^{1/2}$ of less than or equal to 1.35.

4. The toner according to claim 1, wherein a weight average molecular weight of the crystalline polyester resin is from 5,000 to 200,000.

5. The toner according to claim 1, wherein a melting point of the crystalline polyester resin is from 48° C. to 90° C.

6. The toner according to claim 1, wherein a content of the crystalline polyester resin having an unsaturated double bond in the toner is from 30% by weight to 80% by weight with respect to the total weight of the toner.

7. The toner according to claim 1, wherein the thiol compound is pentaerythritol tetrakis(3-mercaptobutylate).

8. The toner according to claim 1, wherein a content of the thiol compound in the toner is from 2% by weight to 20% by weight with respect to the total weight of the toner.

9. The toner according to claim 1, wherein a content of the photopolymerization initiator in the toner is from 1% by weight to 10% by weight with respect to the total weight of the toner.

10. A dry developer comprising the toner according to claim 1.

11. A developer cartridge containing the dry developer according to claim 10.

12. A process cartridge containing the dry developer according to claim 10.

13. A liquid developer comprising:

the toner according to claim 1; and a carrier solution.

14. A developer cartridge containing the liquid developer according to claim 13.

15. A process cartridge containing the liquid developer according to claim 13.

16. An image forming method comprising:

forming a latent image on a surface of an image holding member;

forming a toner image by developing the latent image, which is formed on the surface of the image holding member, using the liquid developer according to claim 13;

transferring the toner image, which is formed on the surface of the image holding member, onto a recording medium;

forming a fixed image by fixing the toner image, which is transferred onto the recording medium, on the recording medium; and curing the fixed image.

17. An image forming method comprising:

forming a latent image on a surface of an image holding member;

forming a toner image by developing the latent image, which is formed on the surface of the image holding member, using the dry developer according to claim 10;

transferring the toner image, which is formed on the surface of the image holding member, onto a recording medium;

forming a fixed image by fixing the toner image, which is transferred onto the recording medium, on the recording medium; and curing the fixed image.

* * * * *